US007185403B2

(12) United States Patent
Chaturvedi

(10) Patent No.: US 7,185,403 B2
(45) Date of Patent: Mar. 6, 2007

(54) ZIPPER SLIDER ASSEMBLY WITH DIAPHRAGM FOR FLEXIBLE PACKAGES

(76) Inventor: Ashok Chaturvedi, 118-119, Damji Shamji Udyog Bhawan, 1st Floor, 25 A, Veera Desai Road, Andheri (West), Mumbai 400 053, Maharashtra (IN)

( * ) Notice: Subject to any disclaimer, the term of this patent is extended or adjusted under 35 U.S.C. 154(b) by 0 days.

(21) Appl. No.: 10/641,293

(22) Filed: Aug. 15, 2003

(65) Prior Publication Data

US 2005/0188511 A1 Sep. 1, 2005

Related U.S. Application Data

(63) Continuation-in-part of application No. 10/448,364, filed on May 30, 2003.

(30) Foreign Application Priority Data

Dec. 27, 2002 (IN) ..... 1159/02
Apr. 29, 2003 (IN) ..... 428/03

(51) Int. Cl.
*A44B 19/16* (2006.01)

(52) U.S. Cl. ..... 24/585.12; 383/64; 383/61.2; 383/5

(58) Field of Classification Search ..... 24/30.5 R, 24/585.11, 585.12, 572.1, 585.1; 383/5, 383/63–65, 61.2
See application file for complete search history.

(56) References Cited

U.S. PATENT DOCUMENTS 3,991,801 A * 11/1976 Ausnit ..... 383/61.2
4,020,884 A * 5/1977 Jadot ..... 383/63
4,791,710 A * 12/1988 Nocek et al. ..... 24/585.12
4,878,763 A * 11/1989 Ausnit ..... 383/65
4,925,316 A * 5/1990 Van Erden et al. ..... 383/210.1
5,242,516 A 9/1993 Custer et al.
5,425,825 A 6/1995 Rasko et al.
5,435,864 A 7/1995 Machacek et al.
5,487,940 A * 1/1996 Bianchini et al. ..... 428/349
6,004,032 A 12/1999 Kapperman et al.
6,071,011 A 6/2000 Thomas et al.
6,257,763 B1 * 7/2001 Stolmeier et al. ..... 383/5
6,287,000 B1 * 9/2001 Buchman ..... 383/5
6,290,390 B1 9/2001 Buchman
6,305,844 B1 10/2001 Boris
6,354,738 B1 * 3/2002 Buckman et al. ..... 383/5
6,360,513 B1 * 3/2002 Strand et al. ..... 53/412
6,499,878 B1 * 12/2002 Dobreski et al. ..... 383/5

(Continued)

FOREIGN PATENT DOCUMENTS

WO WO 03/018417 A1 3/2003

*Primary Examiner*—Jack W. Lavinder
(74) *Attorney, Agent, or Firm*—Sidley Austin LLP

(57) ABSTRACT

The present invention relates an improved slider zipper assembly with a diaphragm for flexible packages comprising:

zipper profile consisting of male element and a female element, said profile having flaps on single side, said male element having at least a pair of notches, which could be coupled to corresponding notches on female elements, a slider to close said zipper profile, and a diaphragm of at least one film sealed between said flaps to seal and make the package tamper proof and act as a barrier wherein the improvement resides in the diaphragm having a score line effected using means for scribing for making it easier and more convenient for the user to tear open and access the contents of the package.

4 Claims, 3 Drawing Sheets

U.S. PATENT DOCUMENTS 6,505,383 B2 1/2003 Machacek et al.
6,572,266 B2 6/2003 Buchman
6,783,276 B2 8/2004 Machacek et al.
6,830,377 B2 * 12/2004 Schneider ..... 383/5

* cited by examiner

ZIPPER SLIDER ASSEMBLY WITH DIAPHRAGM FOR FLEXIBLE PACKAGES

The present patent application is a continuation in part of our copending U.S. patent application Ser. No. 10/448,364 dated 30$^{th}$ May 2003. The subject matter of this patent application is an improvement over the zipper slider assembly with a diaphragm for flexible packages described in the said co-pending patent application.

BACKGROUND OF THE INVENTION

As shown in FIG. 1 of our co-pending US patent application, the slider zipper assembly consists of a male member 1.1 having interlocking element 1.2 and flap 1.3. A female member 1.4 having interlocking element 1.5, a flap 1.6 and rectangular shaped protrusion 1.7 extending from said flap 1.6. A slider 1.8 is shown in the figure for closing and opening the zipper profile. A diaphragm 1.9 is sealed between flaps 1.3,1.6 by ultrasonic or heat sealing device.

One of the advantages of the diaphragm 1.9, as provided by the present invention, is that the diaphragm has the same barrier properties as the body of the flexible package. In prior art packages, even when the body of the package had strong barrier protection, the weak barrier provided by the tamper evident structures such as peel seal used to allow moisture, micro-organisms, undesired aroma and the like to enter into the package. However, the diaphragm 1.9 has the same strong barrier properties as the body of the package itself that provides better protection to the packed contents during storage and transportation.

In FIG. 2 of the accompanying drawings, a slider assembly with a package 2.1 and diaphragm 2.2, a slider 2.3 and zipper assembly 2.4 is shown. The slider 2.3 and zipper assembly 2.4 are made of plastic.

Although the diaphragm described in the said co-pending patent application has strong barrier properties and also provides a tamper evident feature, it is difficult for the end user to tear open the diaphragm to access the contents of the flexible package.

One of the conventional approaches used to overcome the aforementioned drawback involves perforating the diaphragm for making it easier to tear open. However, such a perforation compromises the barrier property of the diaphragm and hence, of the flexible package. Therefore, it is not fit in cases where the barrier is an essential requirement for storing the contents in the flexible package.

The object of this invention is to overcome the above-mentioned drawbacks and provide a zipper slider assembly with diaphragm having a score line for flexible packages that is more convenient for the user to tear open to access the contents of the package and at the same time possesses strong barrier properties for maintaining the desired aroma and freshness of food and other articles packaged inside the flexible package during transportation and storage till such time that they reach the end user.

Another object of this invention is to provide a tamper proof zipper slider assembly for flexible packages.

To achieve the said objectives, this invention provides an improved slider zipper assembly with a diaphragm for flexible packages comprising:

zipper profile consisting of male element and a female element, said profile having flaps on single side, said male element having at least a pair of notches, which could be coupled to corresponding notches on female elements, a slider to close said zipper profile, and a diaphragm of at least one film sealed between said flaps to seal and make the package tamper proof and act as a barrier wherein the improvement resides in the diaphragm having a score line using means for scribing for making it easier and more convenient for the user to tear open and access the contents of the package.

The means for scribing include lasers and water jet technology.

The film is made up of a plastic film or a laminate of at least two films laminated together.

The film is metalized, holographed, printed or plain.

The laminate of films includes at least one layer of aluminum foil.

BRIEF DESCRIPTION OF THE ACCOMPANYING DRAWINGS

The invention will now be described with reference to the accompanying drawings.

DETAILED DESCRIPTION OF THE ACCOMPANYING DRAWINGS

Figure 1:
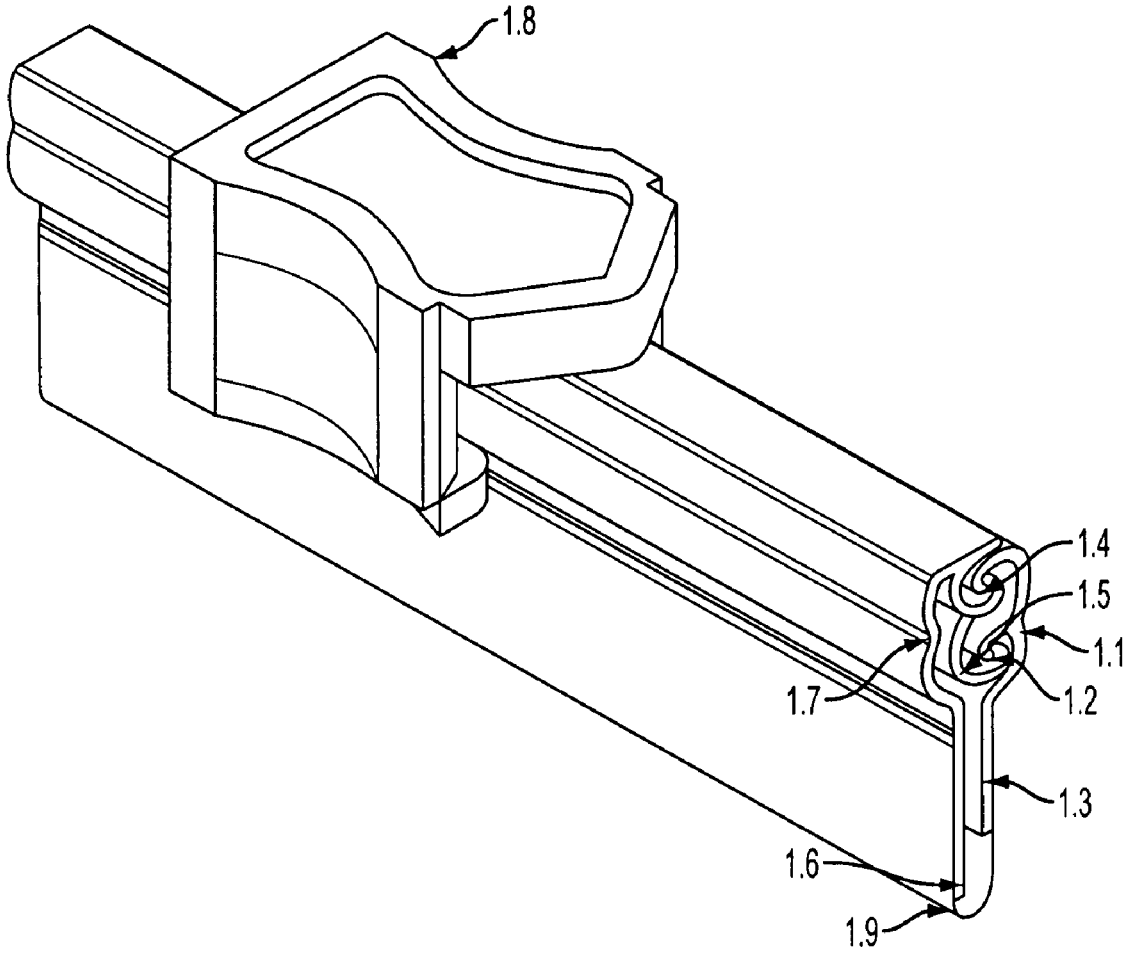
FIG. 1 shows a slider zipper assembly with a diaphragm described in our copending US application.
Figure 2:
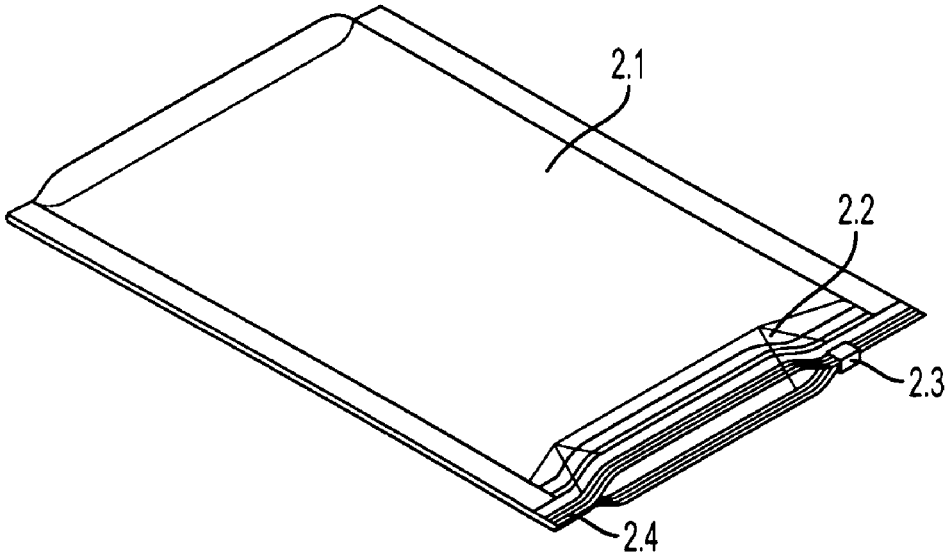
FIG. 2 shows the package with a slider zipper assembly with a diaphragm described in our copending US application.
Figure 3A:
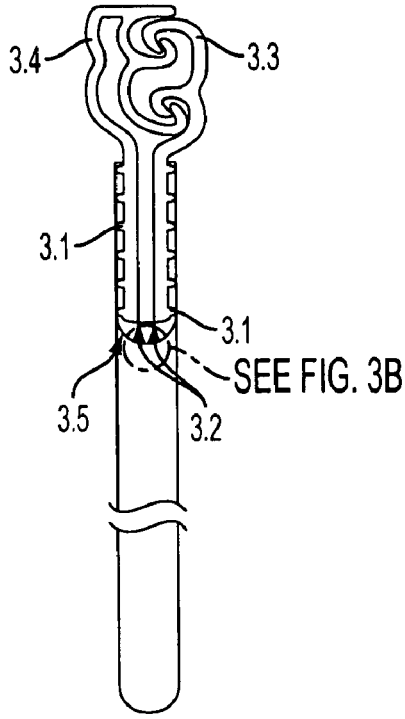
FIG. 3 shows the improved diaphragm with a score line according to the present invention.
Figure 3B:
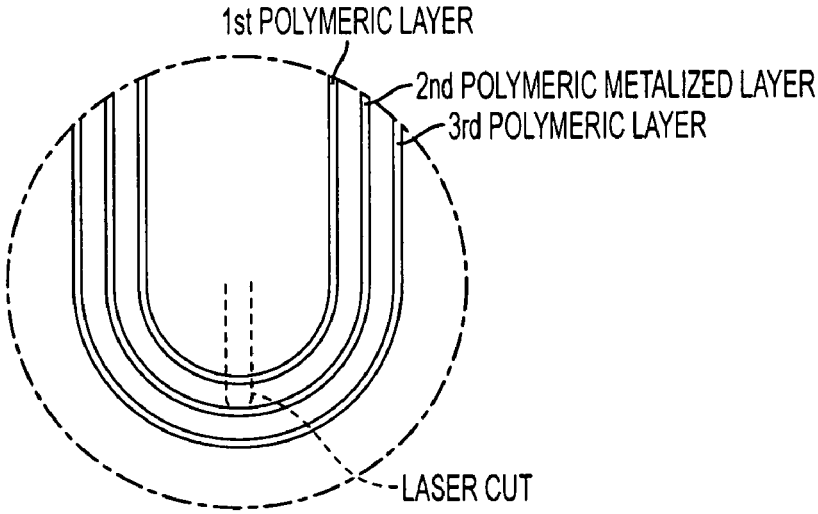

FIG. 3 shows the improved diaphragm with a score line according to the present invention. In the figure, the male element 3.3 and the female element 3.4 of the zipper assembly are shown along with the diaphragm 3.5. The score line is effected by means for scribing for easier opening of the diaphragm to gain access to the contents of the flexible bag. In a preferred embodiment as shown in FIG. 3, the scribing means is a laser for cutting the diaphragm without compromising its strong barrier properties.

The laminate shown in this embodiment comprises three layers: the outer two layers being polymeric and the center layer being a metalized polymeric for providing the strong barrier property. The score line in this case is applied partially such that the depth of the score line is limited only up to metalized structure of the laminate, leaving metalized layer intact and thereby maintaining the strong barrier of the laminate. With such a score line cut in place, user can more easily open the bag by tearing along the score line on the diaphragm.

In another embodiment, the laminate may comprise of an aluminum foil in between two layers of polymeric films or even a combination of a metalized layer and an aluminum foil may also be used to provide an even stronger barrier. In such an embodiment also the partial laser cut is such that the depth of cut is limited only up to the aluminum foil or a combination of the metalized layer and aluminum foil of the laminate as the case may be and thereby maintaining the strong barrier of the laminate.

It may be observed that the laminates used in the above embodiments have been described using only three layers for the ease of illustration and is in no way a limitation of the present invention. A man skilled in the art will appreciate that number of layers and their composition in a laminate may vary as per the requirements of different flexible packages.

I claim:

1. An improved slider zipper assembly with a diaphragm for flexible packages comprising;

a flexible package profile, a zipper profile consisting of male element and a female element, said profile having a first flap extending from said male element and a second flap extending from said female element, said male element having at least a pair of notches, which could be coupled to corresponding notches on female elements, a slider to close said zipper profile, and a diaphragm comprised of at least one metallized laminated film sealed to the first flap and the second flap to seal and make the package tamper proof and act as a barrier, wherein said diaphragm is connected to the external surface of the first flap and the second flap, wherein the diaphragm has barrier protection properties and a score line up to, but leaving intact, the metallized layer of the metallized laminated film effected using means for scribing for making it easier and more convenient for the user to tear open and access the contents of the package.

2. The slider zipper assembly with diaphragm for flexible packages as claimed in claim 1 wherein the means for scribing include lasers and water jet technology.

3. The slider zipper assembly with diaphragm for flexible packages as claimed in claim 1 wherein the film is holographed film or printed film.

4. The slider zipper assembly with diaphragm for flexible packages as claimed in claim 1 wherein the film includes at least one layer of aluminum foil.

* * * * *